US010973302B2

(12) United States Patent
Lee

(10) Patent No.: US 10,973,302 B2
(45) Date of Patent: Apr. 13, 2021

(54) COMPACT CONTAINER HAVING TENSION PART INTEGRALLY FORMED THEREIN

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 222 days.

(21) Appl. No.: 16/305,817

(22) PCT Filed: May 29, 2017

(86) PCT No.: PCT/KR2017/005591
§ 371 (c)(1),
(2) Date: Nov. 29, 2018

(87) PCT Pub. No.: WO2017/217674
PCT Pub. Date: Dec. 21, 2017

(65) Prior Publication Data

US 2019/0183231 A1 Jun. 20, 2019

(30) Foreign Application Priority Data

Jun. 14, 2016 (KR) ..... 10-2016-0073930

(51) Int. Cl.
*A45D 40/22* (2006.01)
*B65D 43/16* (2006.01)
(Continued)

(52) U.S. Cl.
CPC ..... *A45D 40/22* (2013.01); *A45D 33/025* (2013.01); *A45D 40/00* (2013.01); *B65D 43/16* (2013.01);
(Continued)

(58) Field of Classification Search
CPC ..... A45D 40/22; A45D 33/025; A45D 40/00; A45D 2040/0006; A45D 2040/227; B65D 43/16; B65D 43/24; B65D 2251/10
See application file for complete search history.

(56) References Cited

U.S. PATENT DOCUMENTS 5,320,116 A * 6/1994 Ackermann ..... A45C 13/1084 132/293
5,568,820 A * 10/1996 Dirksing ..... A45C 13/005 132/293
(Continued)

FOREIGN PATENT DOCUMENTS

JP 07-9208 U 2/1995
JP 10-211017 A 8/1998
(Continued)

*Primary Examiner* — Nicholas D Lucchesi
(74) *Attorney, Agent, or Firm* — Heedong Chae; Lucem, PC

(57) ABSTRACT

The present invention relates to a compact container having a tension part integrally formed therein, which is a compact container comprising an outer container which is equipped with a button, and an outer container lid which is hinge-coupled to one side of the outer container and opens and closes, wherein a middle body is coupled to the inner side of the outer container, a tension part is integrally formed on one side of the middle body, a lower inclined part of the tension part has an angle of 30-55° and a thickness of 0.5-2.5 mm, and when the outer container lid is closed the lower inclined part is pushed by the outer container lid so as to go 0.2-1.0 mm to the inside.

5 Claims, 7 Drawing Sheets

(51) Int. Cl.

| | |
|---|---|
| ***A45D 33/02*** | (2006.01) |
| ***B65D 43/24*** | (2006.01) |
| ***A45D 40/00*** | (2006.01) |

(52) U.S. Cl.
CPC ..... *B65D 43/24* (2013.01); *A45D 2040/0006* (2013.01); *A45D 2040/227* (2013.01); *A45D 2200/05* (2013.01); *B65D 2251/10* (2013.01)

(56) References Cited

U.S. PATENT DOCUMENTS

| | | | | |
|---|---|---|---|---|
| 7,703,627 | B2 * | 4/2010 | Yuhara | A45D 40/222 220/326 |
| 7,753,228 | B2 * | 7/2010 | Yuhara | A45D 33/006 220/835 |
| 9,452,873 | B2 * | 9/2016 | Eberlein | B65D 55/16 |
| 10,577,156 | B2 * | 3/2020 | Dagnelie | B65D 55/12 |
| 2006/0191948 | A1 * | 8/2006 | Wisniewski | B65D 43/164 220/831 |
| 2007/0090106 | A1 * | 4/2007 | Yuhara | A45D 40/222 220/4.22 |
| 2007/0215494 | A1 * | 9/2007 | Yuhara | A45D 33/006 206/37 |

FOREIGN PATENT DOCUMENTS

| | | | |
|---|---|---|---|
| KR | 20-2015-0003870 | U | 10/2015 |
| KR | 10-2016-0078930 | A | 7/2016 |
| WO | 2016/035968 | A1 | 3/2016 |

* cited by examiner

COMPACT CONTAINER HAVING TENSION PART INTEGRALLY FORMED THEREIN

CROSS-REFERENCE TO RELATED APPLICATIONS

This application is based on and claims the benefit of priority to Korean Patent Application No. 10-2016-0073930 filed on Jun. 14, 2016, with the Korean Intellectual Property Office, the disclosure of which is incorporated herein by reference.

TECHNICAL FIELD

The present invention relates to a compact container having a tension part integrally formed therein, and more particularly, to a compact container having a tension part integrally formed therein, which is a compact container including an outer container provided with a button and an outer container lid hinge-coupled to one side of the outer container so as to be opened and closed, wherein a middle body is coupled to an inner side of the outer container, the tension part is integrally formed on one side of the middle body, a lower inclined part of the tension part is inclined at an angle of 30° to 55° and has a thickness of 0.5 mm to 2.5 mm, and, when the outer container lid is closed, the lower inclined part is pressed by the outer container lid and pushed inward by 0.2 mm to 1.0 mm, so that, when the outer container lid is opened, the tension part pushes an inner peripheral surface of the outer container lid such that the outer container lid is opened smoothly and flexibly, and a cost and a number of processes required for manufacturing or assembling the tension part are reduced to increase productivity.

BACKGROUND ART

In general, cosmetic products used to make faces of users look beautiful are classified into basic cosmetics, functional cosmetics, and color cosmetics according to functions of the cosmetic products.

The color cosmetics are applied to a body such as a face or a nail to express a beautiful skin color by adding a color, and to prevent skin defects that cannot be covered by the base product from being seen.

The color cosmetics are classified into a base makeup used for making a skin color uniform and covering defects, and a point makeup used for partially enhancing a three-dimensional effect of lips, eyes, or nails. The base makeup includes a makeup base, a foundation, and a powder, and the point makeup includes a lipstick, an eye liner, and mascara.

As various color cosmetics are developed as described above, it has become necessary to develop a container capable of containing such color cosmetics. Among the base makeup cosmetics, the foundation has been mainly used in a manner such that the foundation is filled in a glass container or a tube container, and the users take or squeeze some of the foundation on their hands for use and apply the foundation onto the skin by using the hands.

However, according to a foundation container of the related art, there is an inconvenience in that the users are required to wash a cosmetic material put on their hands whenever the users use the cosmetic material, and the cosmetic material is wasted as the cosmetic material put on the hands of the users is washed off as described above.

In order to solve such problems, a compact container with a puff has been developed to allow the users to perform makeup without putting the cosmetic material on the hands of the users, and to make it easy to carry.

However, the compact container of the related art causes an inconvenience that the user has to press a button of a container body to separate the container body from a container lid and lift the container lid with a remaining hand when opening the container lid.

Therefore, in order to allow the container lid to be flexibly opened, as shown in FIG. 1, Korean Utility Model Publication No. 91-14993 is disclosed, in which a conventional compact container is configured such that an elastic member is provided on both sides of a hinge of a container body, so that a container lid is flexibly opened.

However, since the above related art has a structure in which the elastic member is additionally provided so as to be bonded to the both sides of the hinge, there is a problem in that a manufacturing cost and a number of processes required for assembly are increased to decrease productivity.

In addition, when the container is used for a long period of time, the above related art has a problem in that an adhesive force between the elastic member and the container is weakened so as to cause the elastic member to be separated.

In order to solve such problems, the present applicant has filed Korean Patent Application Publication No. 20-2016-0001461 disclosing a compact container as shown in FIG. 2. In the above related art, a tension bar is integrally formed on an upper portion of a hinge of a container lid such that the tension bar presses an upper end of an inner container when the container lid is closed, so that the container lid is flexibly opened without an additional elastic member when a button is pressed to open the container lid.

However, since the above related art has a configuration that the tension bar strongly presses the upper end of the inner container, there is a problem in that the container lid suddenly pops up when the container lid is opened, causing the container to be rather inconvenient to use.

In addition, in the above related art, the upper end of the inner container and a lower surface of the tension bar have to be assembled to make close contact with each other. In a case where a minute error is generated while assembling the inner container, the container lid, and the container body, the tension bar is spaced apart from the upper end of the inner container, so that tension bar fails to properly function, resulting in product defects.

DISCLOSURE

Technical Problem

To solve the problems described above, an object of the present invention is to provide a compact container having a tension part integrally formed therein, which is a compact container including an outer container provided with a button and an outer container lid hinge-coupled to one side of the outer container so as to be opened and closed, wherein a middle body is coupled to an inner side of the outer container, the tension part is integrally formed on one side of the middle body, a lower inclined part of the tension part is inclined at an angle of 30° to 55° and has a thickness of 0.5 mm to 2.5 mm, and, when the outer container lid is closed, the lower inclined part is pressed by the outer container lid and pushed inward by 0.2 mm to 1.0 mm, so that, when the outer container lid is opened, the tension part pushes an inner peripheral surface of the outer container lid such that the outer container lid is opened smoothly and flexibly, and a cost and a number of processes required for manufacturing or assembling the tension part are reduced to increase productivity.

In addition, an object of the present invention is to provide a compact container having a tension part integrally formed therein, wherein the tension part includes a vertical extension part and a lower inclined part, and the lower inclined part is bent inward while making close contact with an inner peripheral surface of an outer container lid, so that, when the outer container lid is opened, the tension part pushes the inner peripheral surface of the outer container lid in a rotation direction of the outer container lid so that the outer container lid is opened naturally.

Technical Solution

According to the present invention, there is provided a compact container having a tension part integrally formed therein, the compact container including:

an outer container (10);

an outer container lid (20) for opening and closing the outer container (10);

a middle body (30) coupled to an inner side of the outer container (10); and a tension part (40) integrally formed on one side of the middle body (30), wherein the tension part (40) includes a vertical extension part (42) and a lower inclined part (44) inclined downward from an upper portion of the vertical extension part (42), and, when the outer container lid (20) is opened, the lower inclined part (44) pushes an inner peripheral surface of the outer container lid (20) such that the outer container lid (20) is opened smoothly and flexibly.

In addition, the compact container may further include an inner container (50) for receiving a cosmetic material and an inner container lid (60) for opening and closing the inner container (50), which are coupled to the inner side of the outer container (10).

In addition, the lower inclined part (44) may be inclined at an angle of 30° to 55° from the vertical extension part (42).

In addition, the lower inclined part (44) may have a thickness of 0.5 mm to 2.5 mm.

In addition, when the outer container lid (20) is closed, the lower inclined part (44) may be pressed by the outer container lid (20) and pushed inward by 0.2 mm to 1.0 mm.

In addition, the lower inclined part (44) may be formed at a lower outer peripheral surface thereof with a tight contact part (442) which makes close contact with the inner peripheral surface of the outer container lid (20) when the outer container lid (20) is closed, and the tight contact part (442) may have a shape bent inward of the lower inclined part (44) at a predetermined angle.

In addition, the tension part (40) may be formed of polypropylene or acrylonitrile butadiene styrene (ABS), and may be double-injection molded or insert-injection molded with the middle body (30).

Advantageous Effects

According to the present invention, a compact container having a tension part integrally formed therein is configured such that a middle body is coupled to an inner side of the outer container, the tension part is integrally formed on one side of the middle body, a lower inclined part of the tension part is inclined at an angle of 30° to 55° and has a thickness of 0.5 mm to 2.5 mm, and, when the outer container lid is closed, the lower inclined part is pressed by the outer container lid and pushed inward by 0.2 mm to 1.0 mm, so that, when the outer container lid is opened, the tension part pushes an inner peripheral surface of the outer container lid such that the outer container lid is opened smoothly and flexibly, and a cost and a number of processes required for manufacturing or assembling the tension part are reduced to increase productivity.

In addition, according to the present invention, a compact container having a tension part integrally formed therein is configured such that the tension part includes a vertical extension part and a lower inclined part, and the lower inclined part is bent inward while making close contact with an inner peripheral surface of an outer container lid, so that, when the outer container lid is opened, the tension part pushes the inner peripheral surface of the outer container lid in a rotation direction of the outer container lid so that the outer container lid is opened naturally.

BEST MODE

Mode for Invention

Hereinafter, a compact container having a tension part integrally formed therein according to one embodiment of the present invention will be described with reference to accompanying drawings.

Figure 1:
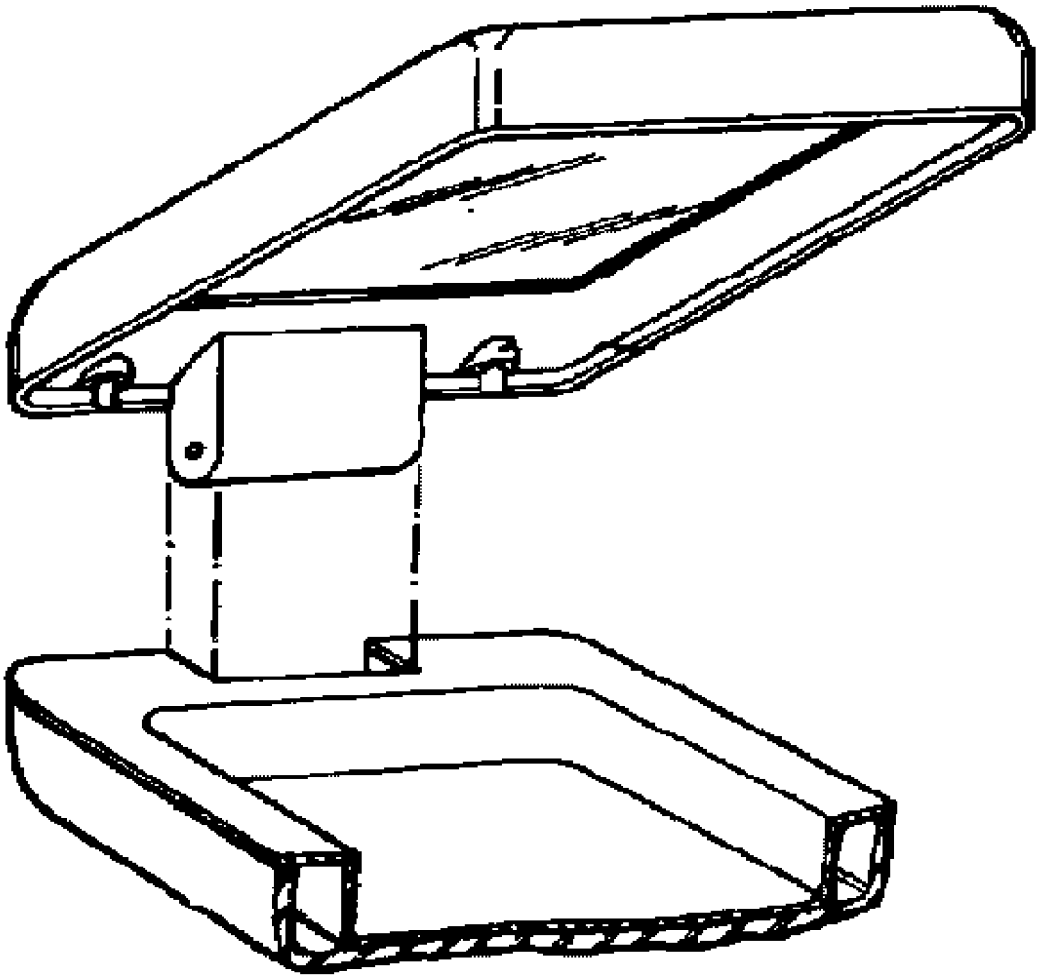
FIG. 1 a view showing a compact container according to the relate art.
Figure 2:
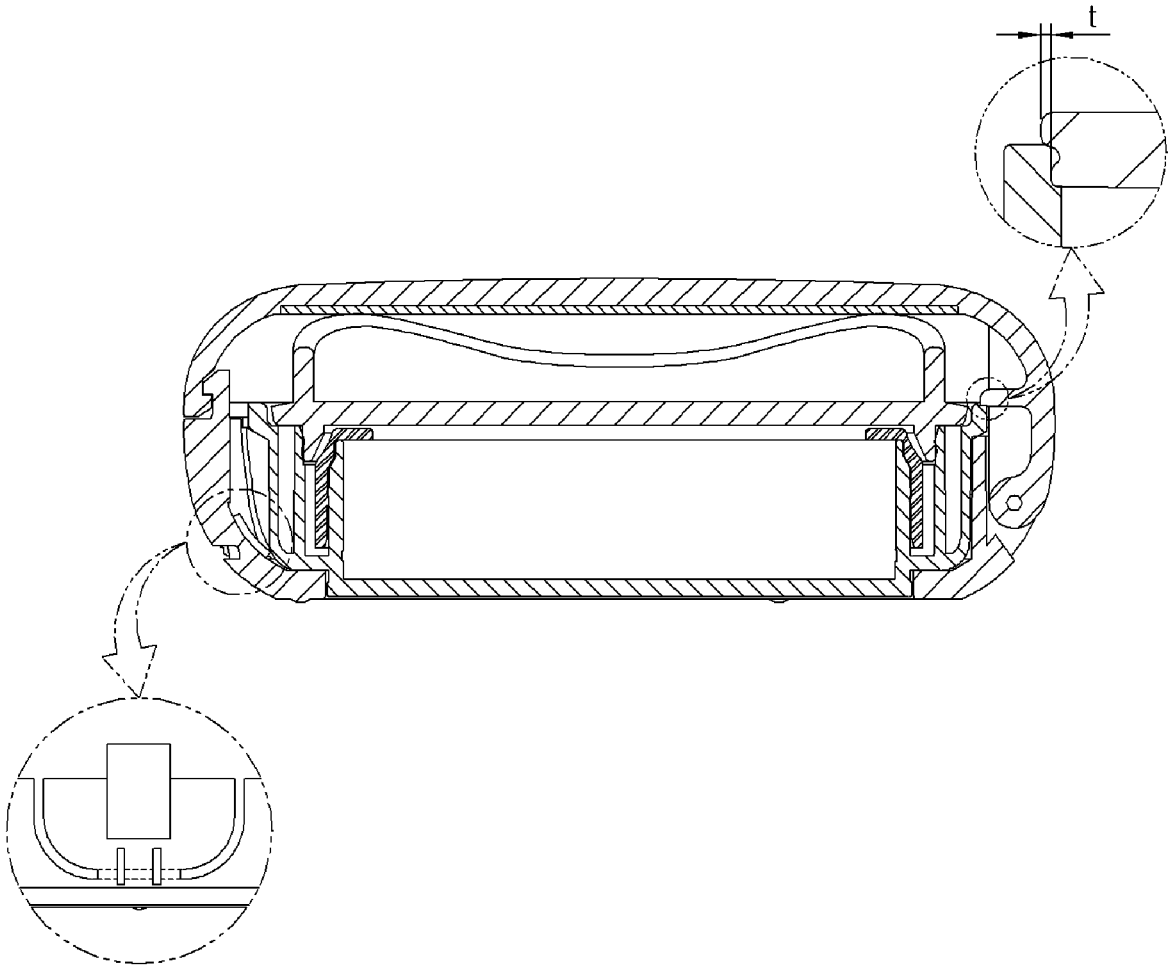
FIG. 2 is a view showing a compact container integrally formed with a button according to the related art.
Figure 3:
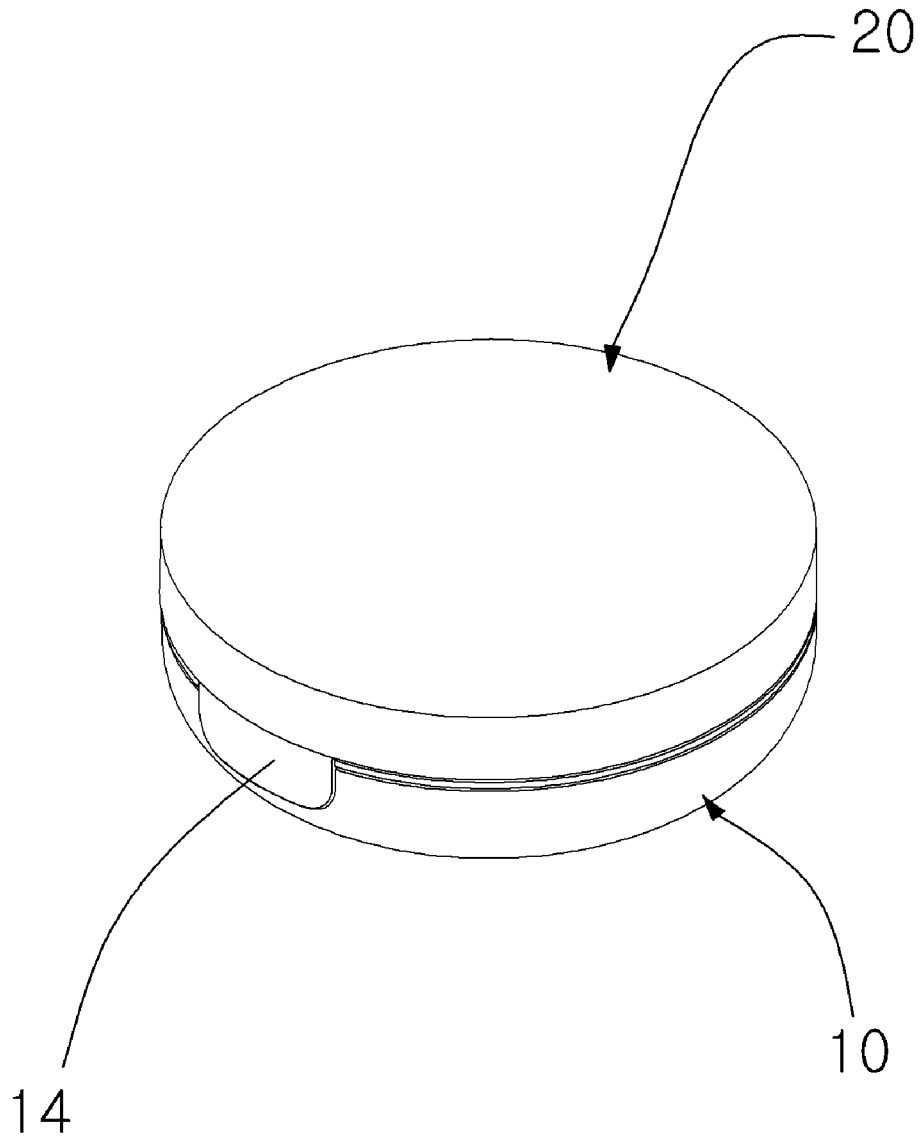
FIG. 3 is a perspective view showing a compact container having a tension part integrally formed therein according to the present invention.
Figure 4:
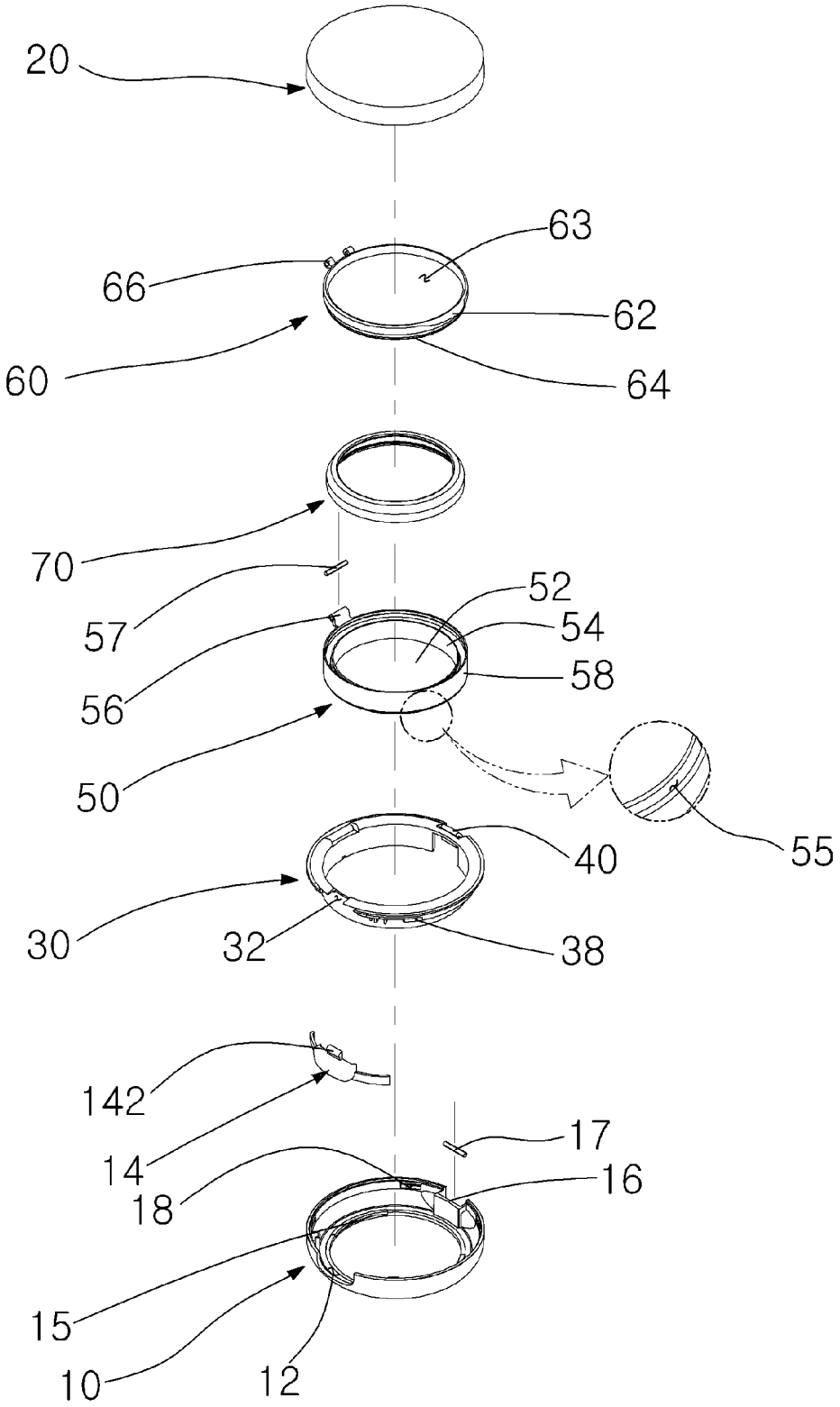
FIG. 4 is an exploded perspective view showing the compact container having the tension part integrally formed therein according to the present invention.
Figure 5:
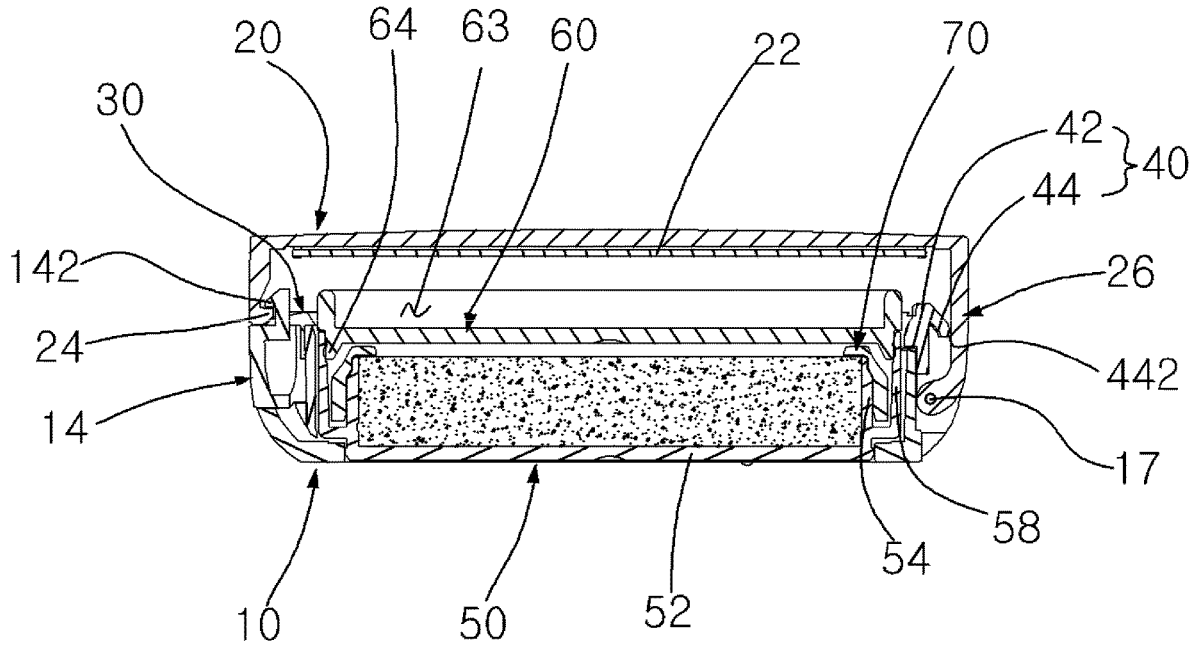
FIG. 5 is a sectional view showing the compact container having the tension part integrally formed therein according to the present invention.

FIG. 3 is a perspective view showing a compact container having a tension part integrally formed therein according to the present invention, FIG. 4 is an exploded perspective view showing the compact container having the tension part integrally formed therein according to the present invention, and FIG. 5 is a sectional view showing the compact container having the tension part integrally formed therein according to the present invention.

According to the present invention, a compact container having a tension part integrally formed therein includes: an outer container 10; an outer container lid 20 for opening and closing the outer container 10; a middle body 30 coupled to an inner side of the outer container 10; and a tension part 40 integrally formed on one side of the middle body 30, wherein the tension part 40 includes a vertical extension part 42 and a lower inclined part 44 inclined downward from an upper portion of the vertical extension part 42, and, when the outer container lid 20 is opened, the lower inclined part 44 pushes an inner peripheral surface of the outer container lid 20 such that the outer container lid 20 is opened smoothly and flexibly.

The outer container 10 has an open top and an open bottom, and the middle body 30 is coupled to the inner side of the outer container 10.

A button insertion hole 12 is formed on one side of the outer container 10 so that a button 14 is coupled to the button insertion hole 12, and a latching protrusion 142 protrudes from an upper portion of the button 14.

A container hinge part 16 is formed on an opposite side of the button insertion hole 12, and a first hinge pin 17 is coupled to the container hinge part 16.

A coupling groove 18 coupled with the middle body 30 is formed in an inner peripheral surface of the outer container 10, and a fastening protrusion 15 coupled with an inner container 50 is formed on a lower side of the coupling groove 18.

The outer container lid 20 is hinge-coupled to one side of the outer container 10 to open and close the outer container 10.

A hook 24 having a protrusion shape and fastened with the latching protrusion 142 of the button 14 is formed on one side of the outer container lid 20, and a mirror 22 may be provided on the inner side of the outer container lid 20 so that a user may easily perform makeup.

A lid hinge part 26 is formed on an opposite side of the hook 24 of the outer container lid 20 and hinge-coupled with the container hinge part 16 of the outer container 10 by the first hinge pin 17.

The compact container may further include an inner container 50 coupled to the inner side of the outer container 10 to receive a cosmetic material or accommodate an impregnation member impregnated with the cosmetic material.

The inner container 50 includes a bottom surface 52, an inner wall 54 extending upward from the bottom surface 52, and an outer wall 58 extending upward while being spaced outward from the inner wall 54 by a predetermined interval.

A fastening groove 55 is formed at a lower outer peripheral surface of the inner container 50 and coupled with the fastening protrusion 15 of the outer container 10.

The inner container lid 60 is hinge-coupled to the inner container 50 to open and close the inner container 50.

An inner container hinge part 56 is formed on one side of the inner container 50, and an inner container lid hinge part 66 is formed on one side of the inner container lid 60 and hinge-coupled to the inner container hinge part 56 by the a hinge pin 57.

A handle 62 protrudes outward from an opposite side of the inner container lid hinge part 66 of the inner container lid 60 so that the user may easily grab the inner container lid 60.

A puff reception groove 63 for receiving a makeup tool such as a puff is formed at a top of the inner container lid 60, and a sealing protrusion wheel 64 protrudes downward from a bottom of the inner container lid 60 to make close contact with an inner peripheral surface of the outer wall 58 of the inner container 50.

The compact container may further include a fixing member 70 coupled to an upper portion of the inner container 50, in which the fixing member 70 is coupled to the inner wall 54 of the inner container 50 to prevent the impregnation member accommodated in the inner container 50 from being separated to an outside.

The middle body 30 is coupled to the inner side of the outer container 10, and a plurality of coupling protrusions 38 coupled to the coupling groove 18 of the outer container 10 are formed at an outer peripheral surface of the middle body 30.

A button through-hole 32 through which an upper portion of the button 14 passes is formed on one side of the middle body 30, and the tension part 40 is formed on an opposite side of the button through-hole 32.

Figure 6:
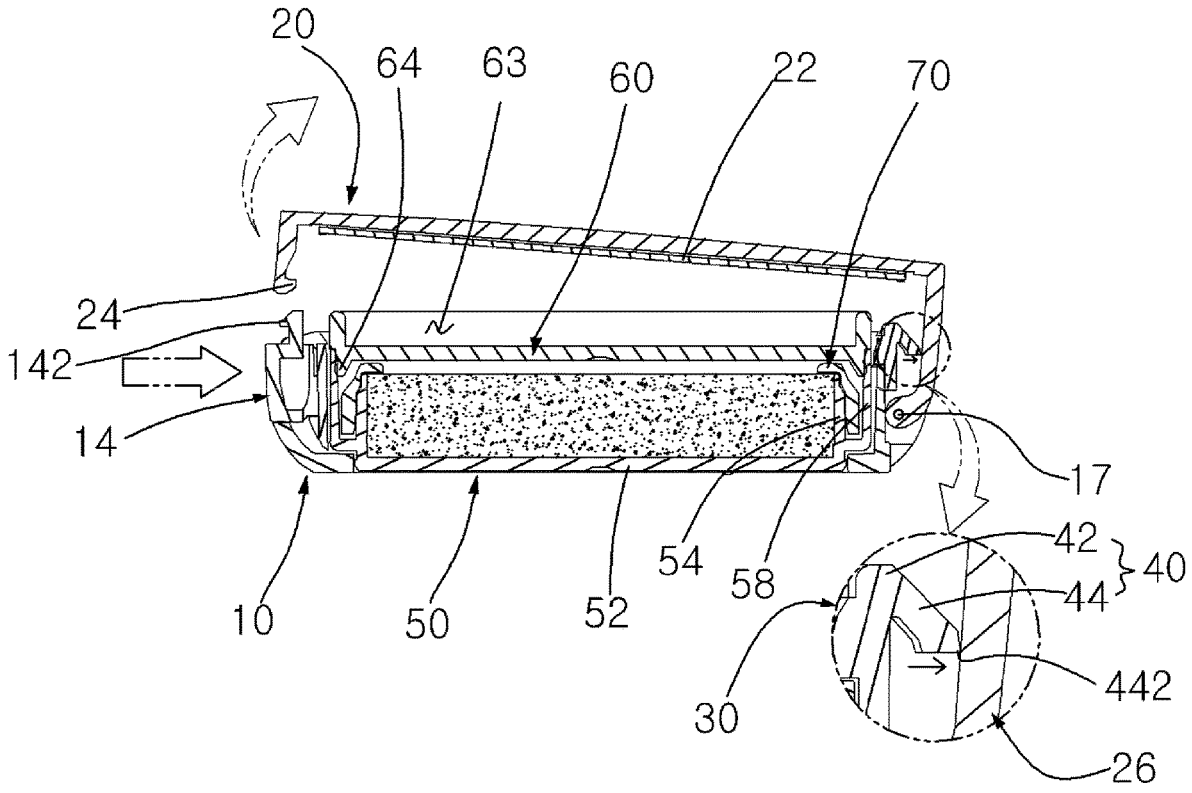
FIG. 6 is a sectional view showing a state in which an outer container lid of the compact container having the tension part integrally formed therein is being opened according to the present invention.
Figure 7:
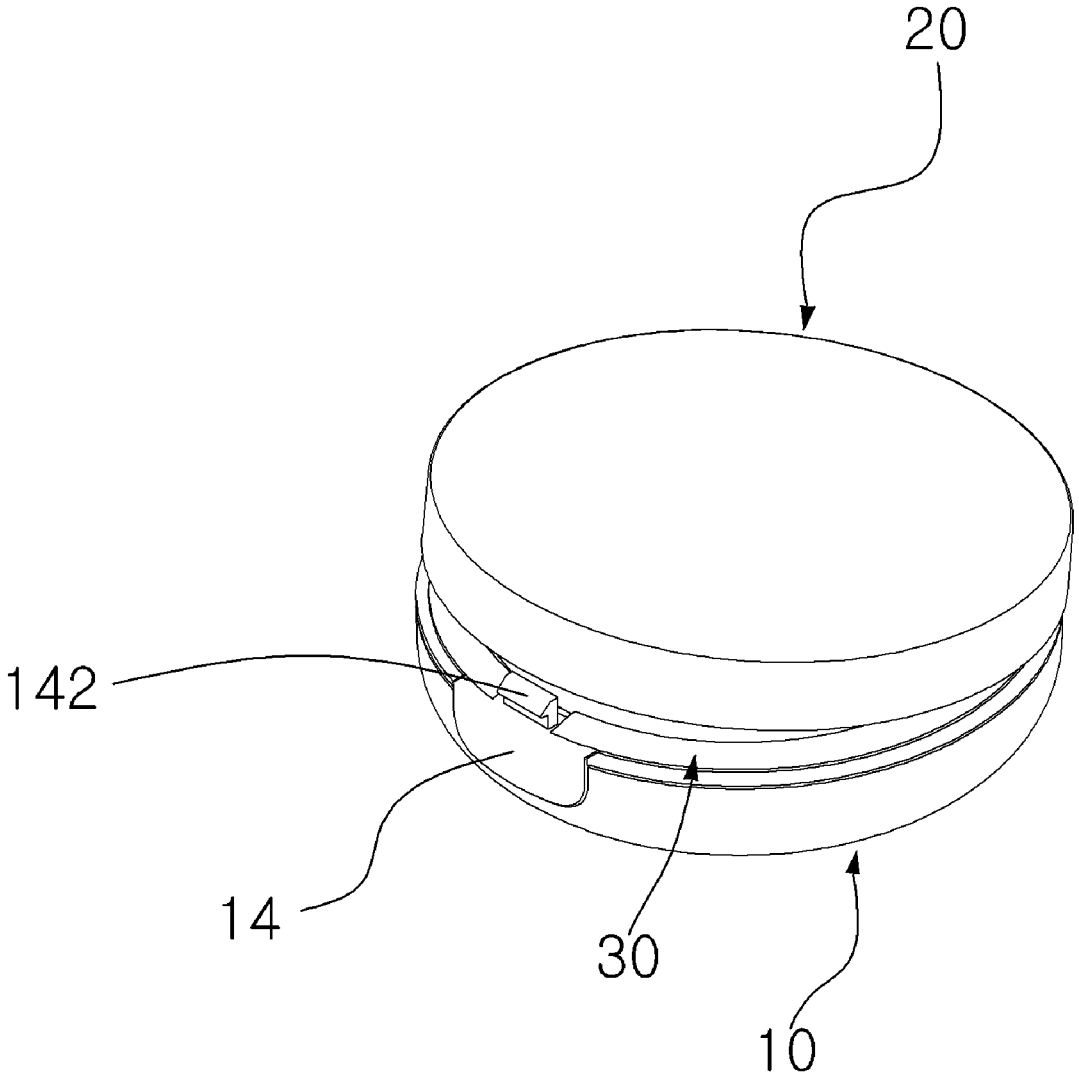
FIG. 7 is a perspective view showing a state in which the outer container lid of the compact container having the tension part integrally formed therein is opened according to the present invention.

FIG. 6 is a sectional view showing a state in which an outer container lid of the compact container having the tension part integrally formed therein is being opened according to the present invention, and FIG. 7 is a perspective view showing a state in which the outer container lid of the compact container having the tension part integrally formed therein is opened according to the present invention.

The tension part 40 is integrally formed at a rear of the middle body 30, and as shown in FIG. 5, the middle body 30 includes the vertical extension part 42 vertically formed on one side of the middle body 30 and the lower inclined part 44 inclined downward from the upper portion of the vertical extension part 42.

The vertical extension part 42 of the tension part 40 connects the middle body 30 to the lower inclined part 44 while supporting the lower inclined part 44.

When the outer container lid 20 is opened as shown in FIG. 6, the lower inclined part 44 of the tension part 40 pushes an inner peripheral surface of the lid hinge part 26 of the outer container lid 20 in a rotation direction of the outer container lid 20 so that the outer container lid is opened naturally.

The lower inclined part 44 may be inclined at an angle of 30° to 55° from the vertical extension part 42.

In detail, when a portion where the upper portion of the vertical extension part 42 is connected to an upper portion of the lower inclined part 44 is considered as an axis, an angle at which the lower inclined part 44 is inclined from the vertical extension part 42 is preferably 30° to 55°.

In a case where the angle of the lower inclined part 44 is less than 30°, the lower inclined part 44 makes close contact with the inner peripheral surface of the lid hinge part 26 of the outer container lid 20 and is compressed by a short distance when the outer container lid 20 is closed, so that the outer container lid 20 is not flexibly opened when the user opens the outer container lid 20.

In a case where the angle of the lower inclined part 44 exceeds 55°, the lower inclined part 44 is excessively lifted such that an end of the lower inclined part 44 appears to penetrate into the lid hinge part 26 of the outer container lid 20 while making contact with the lid hinge part 26 when the outer container lid 20 is closed, so that the lower inclined part 44 is not bent with a tension, and the vertical extension part 42 is pushed rearward. At this time, since there is no space for the vertical extension part 42 to be pushed rearward, the lower inclined part 44 may be damaged, or the outer container lid 20 may not be closed.

In addition, the lower inclined part 44 may have a thickness of 0.5 mm to 2.5 mm.

In a case where the thickness of the lower inclined part 44 is less than 0.5 mm, when the outer container lid 20 is closed, the lower inclined part 44 is pressed by the inner peripheral surface of the lid hinge part 26 of the outer container lid 20, and may be broken and damaged. In a case where the thickness of the lower inclined part 44 exceeds 2.5 mm, when the outer container lid 20 is closed, the lower inclined part 44 is not easily pushed inward while receiving the tension, so that the outer container lid 20 may not be closed, and a hinge coupling portion between the outer container 10 and the outer container lid 20 may be damaged while excessively pressing the outer container lid 20.

In addition, when the outer container lid 20 is closed, it is preferable that the lower inclined part 44 is pressed by the outer container lid 20 and pushed inward by 0.2 mm to 1.0 mm.

In a case where the lower inclined part 44 is pressed by the lid hinge part 26 of the outer container lid 20 and pushed inward by less than 0.2 mm when the outer container lid 20 is closed, when the outer container lid 20 is opened, the lower inclined part 44 pushes the outer container lid 20 with a weak force, so that the outer container lid 20 may not be flexibly opened.

In a case where the lower inclined part 44 is pressed by the lid hinge part 26 of the outer container lid 20 and pushed inward by more than 1.0 mm when the outer container lid 20 is closed, when the outer container lid 20 is opened, the lower inclined part 44 pushes the outer container lid 20 with an excessively strong force, so that the outer container lid 20 may suddenly pop up, causing the compact container to be rather inconvenient to use.

The lower inclined part 44 may be formed at a lower portion thereof with a tight contact part 442, and the tight contact part 442 may have a round shape or a shape bent inward of the lower inclined part 44 at a predetermined angle as shown in an enlarged view of FIG. 6.

The tight contact part 442 makes direct contact with the inner peripheral surface of the lid hinge part 26 of the outer container lid 20 when the outer container lid 20 is closed, and pushes the lid hinge part 26 of the outer container lid 20 in the rotation direction of the outer container lid 20 when the outer container lid 20 is opened.

The tension part 40 may be formed of polypropylene or acrylonitrile butadiene styrene (ABS), and may be double-injection molded or insert-injection molded with the middle body 30.

Hereinafter, a method of assembling the compact container having the tension part integrally formed therein, which has a configuration as described above, will be described.

In order to assemble the compact container having the tension part integrally formed therein according to the present invention, as shown in FIGS. 4 and 6, the button 14 is firstly coupled to the button insertion hole 12 of the outer container 10, and the middle body is coupled to the inner side of the outer container 10, such that a coupling protrusion 38 of the middle body 30 is coupled to the coupling groove 18 of the outer container 10.

At this time, the tension part 40 is integrally formed on one side of the middle body 30.

Next, the inner container lid 60 is hinge-coupled to one side of the inner container 50, the cosmetic material is filled in the inner container 50 or accommodated therein with the impregnation member impregnated with the cosmetic material, and the fixing member 70 is coupled to the upper portion of the inner container 50.

Thereafter, the inner container 50 assemble as described above is mounted in the outer container 10, such that the inner container 50 is inserted at an inner side of the middle body 30, and the fastening protrusion 15 of the outer container 10 is coupled to the fastening groove 55 of the inner container 50.

Finally, the outer container lid 20 is hinge-coupled to one side of the outer container 10 to complete the assembly of the compact container having the tension part integrally formed therein according to the present invention.

Hereinafter, a method of using the compact container having the tension part integrally formed therein, which is assembled as described above, will be described.

In order to use the compact container having the tension part integrally formed therein according to the present invention, the button 14 is firstly pressed to release a fastening state of the latching protrusion 142 of the button 14 and the hook 24 of the outer container lid 20.

In this case, the tension part 40, which has been pressed by the outer container lid 20, pushes the inner peripheral surface of the lid hinge part 26 of the outer container lid 20 in the rotation direction of the outer container lid 20 as shown in FIG. 6, so that the outer container lid 20 is lifted upward smoothly and flexibly as shown in FIG. 7.

Thereafter, the handle 62 of the inner container lid 60 coupled to the top of contents 50 is held and rotated to open the inner container lid 60 from the inner container 50, and the cosmetic material received in the inner container 50 is put on a makeup tool such as a puff and evenly applied to a skin.

After the makeup is completely performed, the inner container lid 60 is rotated to close the inner container 50, and the outer container lid 20 is rotated to close the outer container 10.

In this case, the inner peripheral surface of the lid hinge part 26 of the outer container lid 20 presses the tension part 40, so that the tension part 40 is pushed inward.

As described above, although the compact container having the tension part integrally formed therein according to one embodiment of the present invention has been described for illustrative purposes, the present invention is not limited thereto. It is understood that various changes and modifications can be made by those skilled in the art without departing from the spirit and scope of the present invention as disclosed in the appended claims.

[Description of Reference Numerals]

| | |
|---|---|
| 10: Outer container | 14: Button |
| 20: Outer container lid | 26: Lid hinge part |
| 30: Middle body | 32: Button through-hole |
| 40: Tension part | 42: Vertical extension part |
| 44: Lower inclined part | 50: Inner container |
| 60: Inner container lid | 70: Fixing member |
| 442: Tight contact part | |

The invention claimed is:

1. A compact container having a tension part integrally formed therein, the compact container comprising:

an outer container (10);

an outer container lid (20) for opening and closing the outer container (10);

a middle body (30) coupled to an inner side of the outer container (10); and a tension part (40) integrally formed on one side of the middle body (30), wherein the tension part (40) includes a vertical extension part (42) and a lower inclined part (44) inclined downward from an upper portion of the vertical extension part (42), and, when the outer container lid (20) is opened, the lower inclined part (44) pushes an inner peripheral surface of the outer container lid (20) such that the outer container lid (20) is opened smoothly and flexibly.

2. The compact container of claim 1, wherein the lower inclined part (44) is inclined at an angle of 30° to 55° from the vertical extension part (42).

3. The compact container of claim 1, wherein the lower inclined part (44) has a thickness of 0.5 mm to 2.5 mm.

4. The compact container of claim 1, wherein, when the outer container lid (20) is closed, the lower inclined part (44) is pressed by the outer container lid (20) and pushed inward by 0.2 mm to 1.0 mm.

5. The compact container of claim 1, wherein the lower inclined part (44) is formed at a lower outer peripheral surface thereof with a tight contact part (442) which makes close contact with the inner peripheral surface of the outer container lid (20) when the outer container lid (20) is closed, and the tight contact part (442) has a round shape or a shape bent inward of the lower inclined part (44) at a predetermined angle.

* * * * *